US007748426B2

(12) United States Patent
Feijen

(10) Patent No.: US 7,748,426 B2
(45) Date of Patent: Jul. 6, 2010

(54) ENVELOPE CLOSING MECHANISM AND METHOD FOR CLOSING AN ENVELOPE

(75) Inventor: Fransiscus Hermannus Feijen, Leeuwarden (NL)

(73) Assignee: NEOPOST Technologies, Bagneux (FR)

( * ) Notice: Subject to any disclaimer, the term of this patent is extended or adjusted under 35 U.S.C. 154(b) by 1115 days.

(21) Appl. No.: 11/319,236

(22) Filed: Dec. 27, 2005

(65) Prior Publication Data

US 2006/0185788 A1 Aug. 24, 2006

(30) Foreign Application Priority Data

Dec. 24, 2004 (NL) ..... 1027889

(51) Int. Cl.
*B43M 5/00* (2006.01)

(52) U.S. Cl. ..... 156/442.1; 156/441.5; 156/442.2; 53/378.3; 53/460

(58) Field of Classification Search ..... 156/441.5, 156/442, 442.1, 442.2, 442.3, 442.4; 53/284.3, 53/378.3, 460
See application file for complete search history.

(56) References Cited

U.S. PATENT DOCUMENTS

| | | | | |
|---|---|---|---|---|
| 3,253,384 A | | 5/1966 | Huck et al. | 53/53 |
| 4,428,794 A | | 1/1984 | Hayskar et al. | 156/442.1 |
| 4,773,962 A | * | 9/1988 | Garrigue et al. | 156/441.5 |
| 4,924,652 A | | 5/1990 | Krasuski et al. | 53/55 |
| 4,932,188 A | * | 6/1990 | Krasuski et al. | 53/64 |
| 5,770,005 A | | 6/1998 | Staniszewski | 156/442.1 |
| 5,819,666 A | | 10/1998 | Ishikawa et al. | 101/483 |
| 5,899,050 A | | 5/1999 | Bergwerf | 53/460 |

FOREIGN PATENT DOCUMENTS

| | | |
|---|---|---|
| DE | 1 461 690 | 1/1969 |
| EP | 0 100 674 A2 | 2/1984 |
| EP | 0 781 671 A1 | 7/1997 |
| GB | 2 386 360 A | 9/2003 |
| WO | WO 01/64454 A1 | 9/2001 |

* cited by examiner

*Primary Examiner*—John L Goff
(74) *Attorney, Agent, or Firm*—Sughrue Mion, PLLC

(57) ABSTRACT

An envelope closing mechanism with a deflector (11; 61) for urging a flap (6) of an envelope (3) from the transport path (20; 70); and a moistener (7) for moistening at least a portion of the flap (6) of an envelope (3). The deflector (11; 61) is movable between a position of rest on a side of the transport path (20; 70) located opposite the moistener, and a deflecting position on the other side of the transport path (20; 70) for urging the flap (6) of the envelope (3) against the moistener (7). If the deflector (11, 61) is in the deflecting position, it releases the transport path (20; 70) for transporting the envelope (3) along the deflector (11, 61). From a position in which the flap (6) of the envelope (3) extends between the moistener (7) and the deflector (11) in a deflecting position, the envelope (3), following the transport path (20; 70) is transported along the deflector (11) in the deflecting position with the fold leading. A method for closing envelopes is also described.

11 Claims, 5 Drawing Sheets

ENVELOPE CLOSING MECHANISM AND METHOD FOR CLOSING AN ENVELOPE

CROSS-REFERENCE TO RELATED APPLICATIONS

This application claims priority from Dutch Patent Application No. NL 1027889, filed on Dec. 24, 2004.

FIELD AND BACKGROUND OF THE INVENTION

The invention relates to an envelope closing mechanism and to a method for closing an envelope.

Envelope closing mechanisms are used for closing envelopes in a mechanized manner and are, in practice, often also designed for filling the envelopes, in which case such devices are designated, in practice, as inserters.

From European patent application 0 100 674, an envelope closing mechanism and a method are known in which the envelope is supplied with the flap leading, and urged from the path by the deflector, against a water wheel located below the path, which wets the flap until the relatively rigid envelope body filled with content urges the freely movable deflector away from the water wheel again. Moreover, the flap contacts a flap guide also located below the transport path and downstream of the water wheel, thereby folding the flap to a closed position.

A drawback of this known envelope closing mechanism is that the construction is relatively complex and that, especially at high processing speed and with soft envelopes, it is difficult to prevent moisture from the water wheel and glue dissolved therein coming from previously wetted envelopes, from ending up on the body and the content of the envelope.

SUMMARY OF THE INVENTION

It is an object of the invention to provide a solution that enables moistening and closing the flaps of envelopes by means of a simple construction, while staining the body and the content of the envelope with moisture and glue is prevented in a reliable manner.

According to the present invention, this object is achieved by providing an envelope closing mechanism, comprising:

a guide for guiding an envelope in a transport path;

a transport structure for moving the envelope in at least one transport direction along the transport path;

a deflector for urging a flap of an envelope connected along a fold to an envelope body of the envelope from the transport path; and a moistener for moistening at least a portion of the flap of an envelope at a position on a first side of the transport path and at a distance from the transport path;

wherein the deflector is movable between a position of rest on a second side of the transport path located opposite the moistener, and a deflecting position on said first side of the transport path for urging at least a portion of the flap of the envelope against the moistener, in which deflecting position the deflector is free from the transport path for allowing the envelope to pass the deflector during transport along the transport path; and wherein the transport structure is controllable for transporting the envelope from a position in which the flap of the envelope extends between the moistener and the deflector in the deflecting position, with said fold leading and following the transport path along the deflector in the deflecting position.

The invention can also be embodied in a method for closing an envelope having an envelope body for accommodating a content, and a flap connected along a fold to the envelope body, from a position in which the envelope body and the flap extend in transport direction of a transport path, comprising:

pivoting the flap out of the transport path by a deflector into a position in which the flap of the envelope extends between a moistener and the deflector in the deflecting position; and transporting the envelope along the transport path with the fold leading and following the transport path along the deflector in the deflecting position, while the flap moves along the moistener and pivots to a position against the envelope body.

As upon transport, the envelope is fed with the fold leading and following the transport path along the deflector in the deflecting position, other parts of the envelope and the content remain at a relatively large distance from the moistener, and the deflector needs not be urged from the deflecting position by the envelope body. The deflector in the deflecting position keeps the envelope body away from the moistener so that the risk of staining the envelope body and the content is considerably reduced.

An additional advantage is that as, upon closing, the flap travels around the deflector, one single deflector can suffice for urging the flap of the envelope towards the deflector and to the closed position.

Design aspects of the invention are laid down in the dependent claims and appear from the following description of exemplary embodiments represented in the drawings, in which also further effects and design details of the invention are laid down.

DETAILED DESCRIPTION

Figure 1:
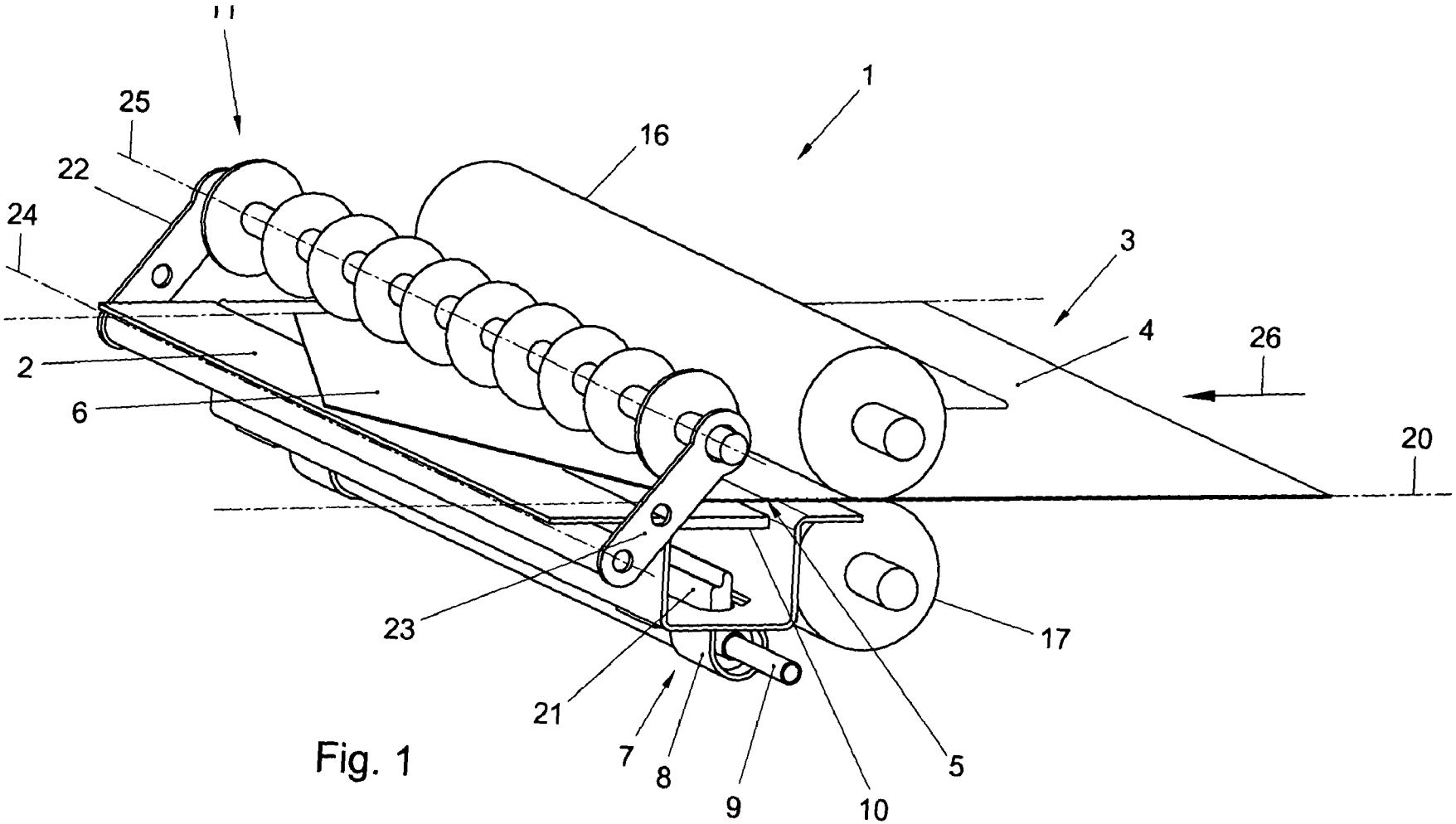
FIGS. 1-4 are schematized perspective representations of an example of an envelope closing mechanism according to the invention in successive operative conditions which occur during a cycle of an example of a method according to the invention.

The envelope closing mechanism 1 according to the example shown in FIGS. 1-4 is equipped with a guide 2 for guiding an envelope 3 in a transport path 20. The envelopes to be closed are of the type having an envelope body 4 for accommodating a content, and a flap 6 connected via a fold 5 to one of two walls of the envelope body 4. Here, the fold 5 proceeding along the flap 6 forms a hinge about which the flap 6, upon closing, hinges relative to the envelope body 4. Such an envelope 3 is represented in FIG. 1. It lies flat in the transport path 20 while a side of the flap 6, provided locally with glue, is in open position facing downward.

A pair of roller presses 16, 17, of which presses one is drivable, form a transporting structure for moving the envelope 3 along the transport path 20.

At a first side of the transport path 20 (according to this example, the underside, but the construction can also, in principle, be placed upside down or at an inclination, in which case the upper side, a lateral side or an upward or downward facing side of the transport path forms the first side) a moistener 7 is situated for moistening the flap 6. According to this example, the moistener 7 is equipped with a moistening cushion 21, a liquid reservoir 8 and a liquid pump 9 for pumping the liquid in a dosed manner to the moistening cushion 21, and is located at some distance from the transport path 20. Due to the dosed supply of liquid, sufficient moistening with a limited risk of spilling can be realized.

With the envelope closing mechanism 1 in the position of rest, the moistener 7 is shielded from the envelope 3 by a hinged panel 10, thereby preventing uncontrolled moistening of the flap 6 or other parts of the envelope 3. According to this example, this panel 10 is urged to its shielding position through spring force, so that it is designed to be self-closing in a simple manner.

In a position of rest (see FIG. 1), a deflector 11, movable between two positions, is situated on a side of the transport path 20 opposite the moistener 7, according to this example, the top side. Via two arms 22,23, the deflector 11 is pivotally suspended about an axis 24 (see FIG. 1). In the so-called deflecting position (see FIGS. 2-4), the deflector 11 is located at the same side of the transport path as the moistener 7.

Figure 2:
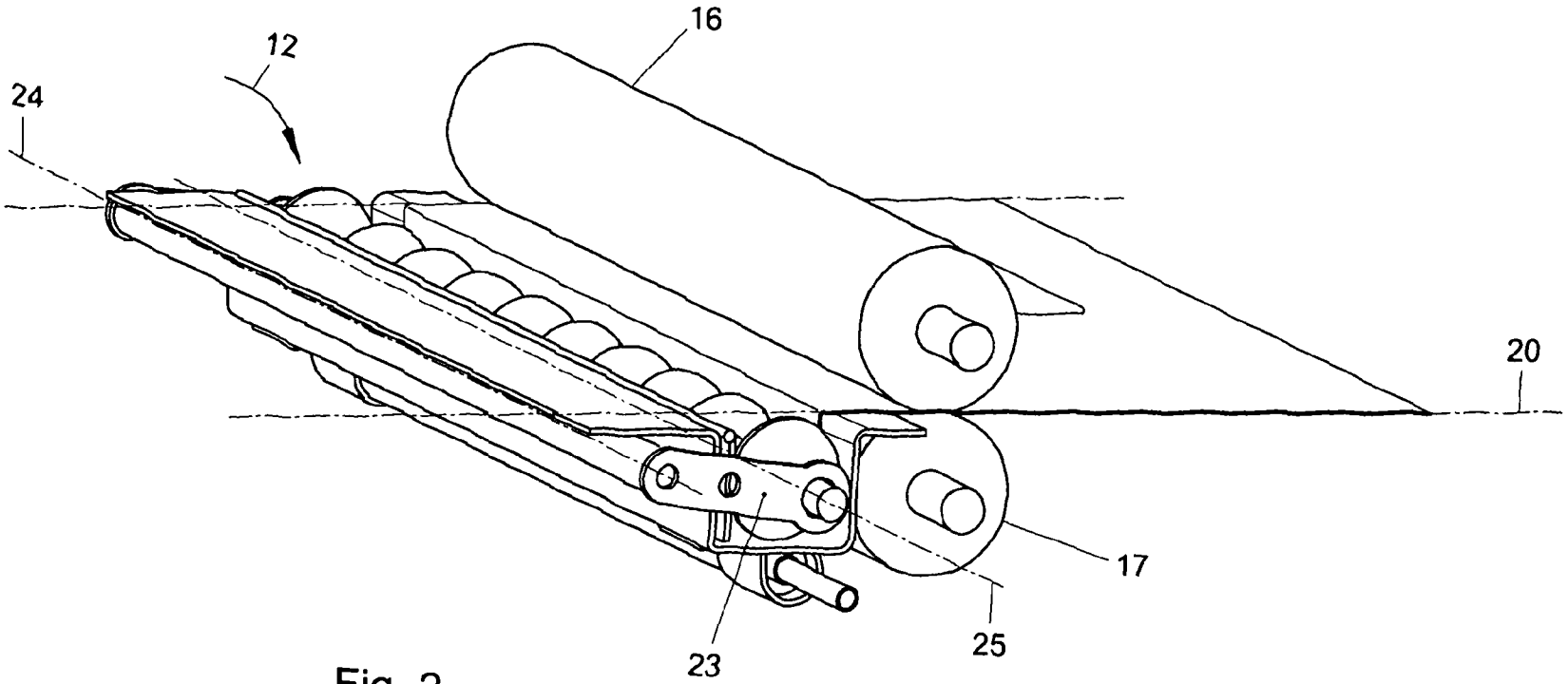

According to this example, the deflector 11 is designed as a row of discs, axially spaced, coaxially and rotatably suspended about a rotation axis 25 (see FIGS. 1 and 2). The rotation axis 25 is directed parallel to the plane of the transport path 20 defined by the guide 2, and moves with the deflector 11 upon displacement thereof between the position of rest and the deflecting position. It is noted that within the framework of the invention, also other designs of the suspension and the construction and shape of the deflector 11 are possible.

In operation, through suitable control of the drive of the roller presses 16, 17, an envelope 3 is brought to a position in which the fold 5 between the body 4 and the flap 6 of the envelope 3 is located approximately opposite the deflector 11. To this end, means known per se can be used, such as a transport control as described in U.S. Pat. No. 5,899,050. The envelope 3 can for instance be fed in a direction as represented with an arrow 26 in FIG. 1, in other words, with the flap leading and reaching the deflector 11 from a side thereof where the roller presses 16, 17 are located.

By then moving the deflector 11 in the direction indicated with arrow 12 in FIG. 2 from the position of rest to the deflecting position, the deflector 11 urges both the panel 10 to its releasing position and the flap 6 from the transport path against the moistener 7 which, initially, was shielded by the panel 10. The contact between the flap 6 and the moistener 7 can be effected by pushing the flap 6 in a nip between the deflector 11 and the moistener 7 against the moistener 7, or conversely, by bending the flap 6 towards the moistener 7 in such a manner that a part of the flap 6 projecting from the deflector is pushed against the moistener 7 without a nip between the moistener 7 and the deflector 11 being involved. This latter is preferred because this further limits the risk of moisture being transferred by the deflector 11 from the moistener 7 onto the envelope 3 or a subsequent envelope and thus staining the envelope with moisture and glue dissolved therein coming from the previously moistened envelopes.

Figure 3:
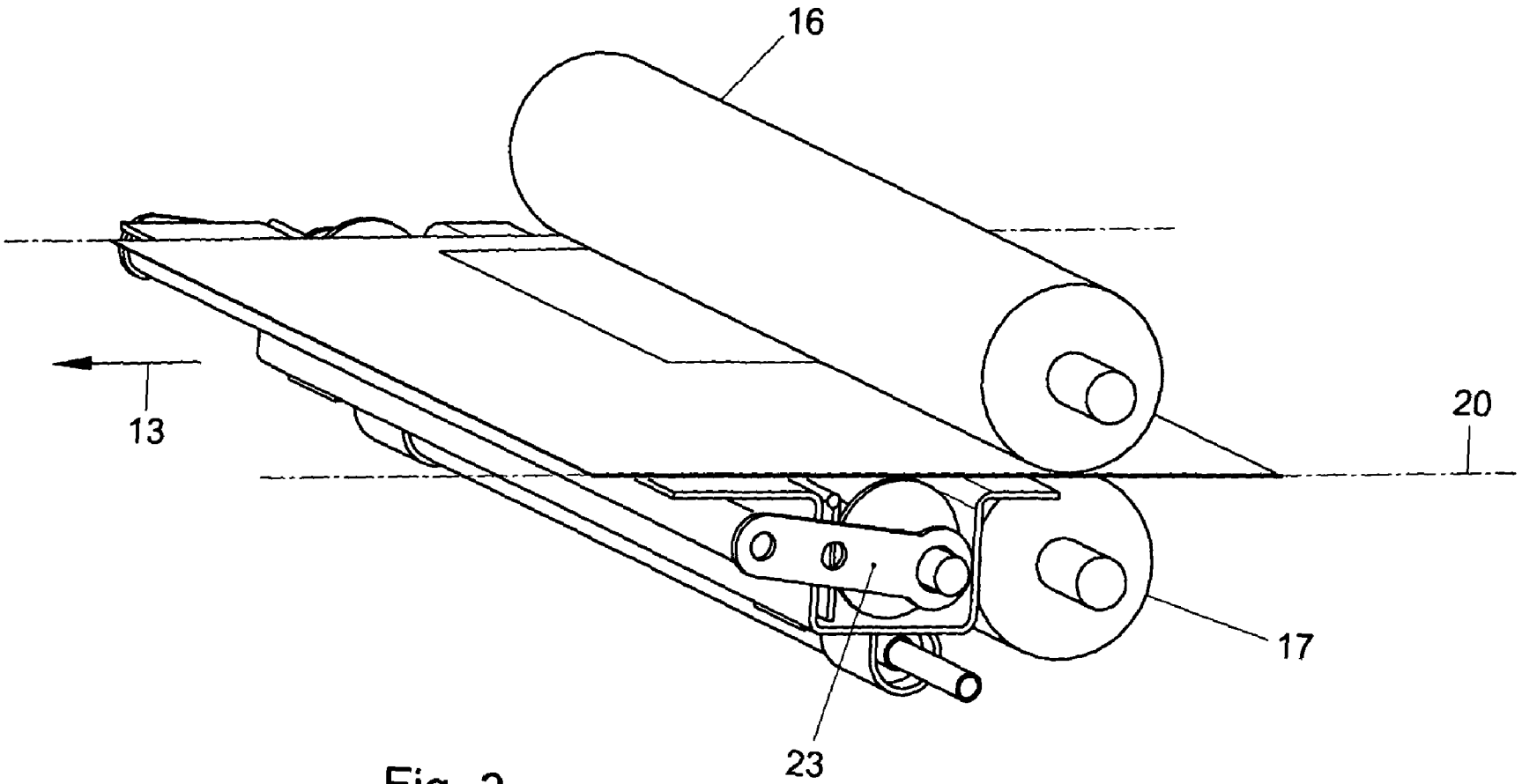
Figure 4:
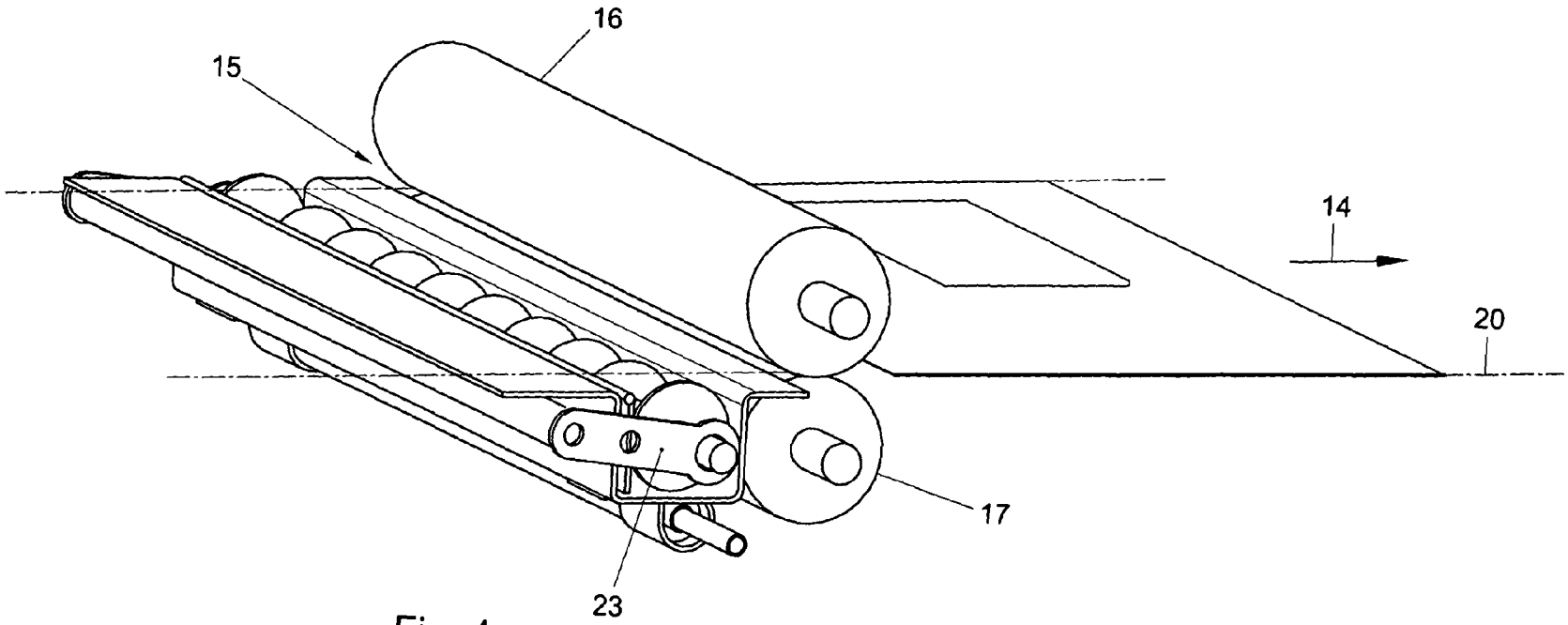

Then, as represented with arrow 13 in FIG. 3, the envelope is moved with the fold 5 leading, along the transport path 20, whereby the leading fold 5 displaces the parts of the envelops 3 contiguous thereto, following the transport path 20, along the deflector 11 which is in deflecting position. Here, the flap 6 is pulled from between the moistener 7 and the deflector 11, is moistened, and runs approximately from the leading fold 5 down over the deflector 11 to a closed position. Here, running the flap 6 gradually over the deflector 11 is promoted in that the deflector comprises a roller which is rotatable about the rotation axis 25 parallel to a plane in which envelopes 3 extend in the path 20.

As the parts 4 of the envelope which are not to be moistened pass the deflector 11 only at a distance from the part of the deflector 11 located opposite the moistener 7, the risk of staining the parts 4 of the envelope 3 which should not be moistened is reduced. Further, due to friction between the flap 6 and the moistener 7, the flap 6 is held tightly around the deflector 11 so that staining of the mechanism in the area of the moistener 7 is prevented.

With a mechanism according to the example shown, staining the envelope is further prevented in that the moistener 7 is situated on a side of the deflector 11 remote from the transport path 20 if the deflector is in the deflecting position. Thus, the deflector 11 moreover forms a shield between the transport path 20 and the moistener 7, thereby further reducing the risk of staining an envelope or the content thereof.

Further, for preventing direct contact between parts 4 of the envelope 3 that are not to be moistened and the moistener 7, it is not required that the deflector 11 moves from its deflecting position. Closing the flap 6 can therefore, after moistening, be carried out very rapidly without a highly accurately timed control of movements of the deflector 11 being required, or movements of the deflector 11 driven by the body 4 of the envelope 3 being required, which can hardly be reliably ensured, especially with relatively soft envelopes.

As, the deflector 11 is of elongated design in cross direction of the transport path 20, it can, upon closing, urge the flap 6 of the envelope 3 in a bend with a small radius, so that reliable pressing against the moistener situated at the outside of this bend can be guaranteed in a simple manner.

After closing the flap 6 of the envelope 3, the envelope 3 is led in opposite direction (arrow 14 in FIG. 4) through a closing nip 15 between the roller presses 16, 17, for pressing-on the folded-up flap 6. Thus, a good adhesion of the surface of flap 6, locally moistened and provided with glue, and parts of the envelope body 4 abutting against it is promoted. With the exemplary embodiment shown in FIGS. 1-4, the closing nip 15 is formed by the roller presses 16, 17 located on either side of the transport path.

As the envelope 3, when fed with the flap leading, and discharged after closing of the flap 6 in a direction opposite the feed direction 26, is always held between the roller presses 16, 17, no separate driven transport means are required, but the same rollers can be used for transporting the envelope 3 and for pressing-on the closed flap 6.

It is noted that various embodiments are possible such as, for instance, instead of two mutually opposed roller presses, one roller press combined with a circulating or not circulating press-on surface. Further, the closing nip 15 can also, viewed in feed direction, be placed downstream of the deflector 11. This latter offers the advantage that the envelope can be closed without reversing the transport direction, which is advantageous for increasing the capacity of the mechanism.

Figure 5:
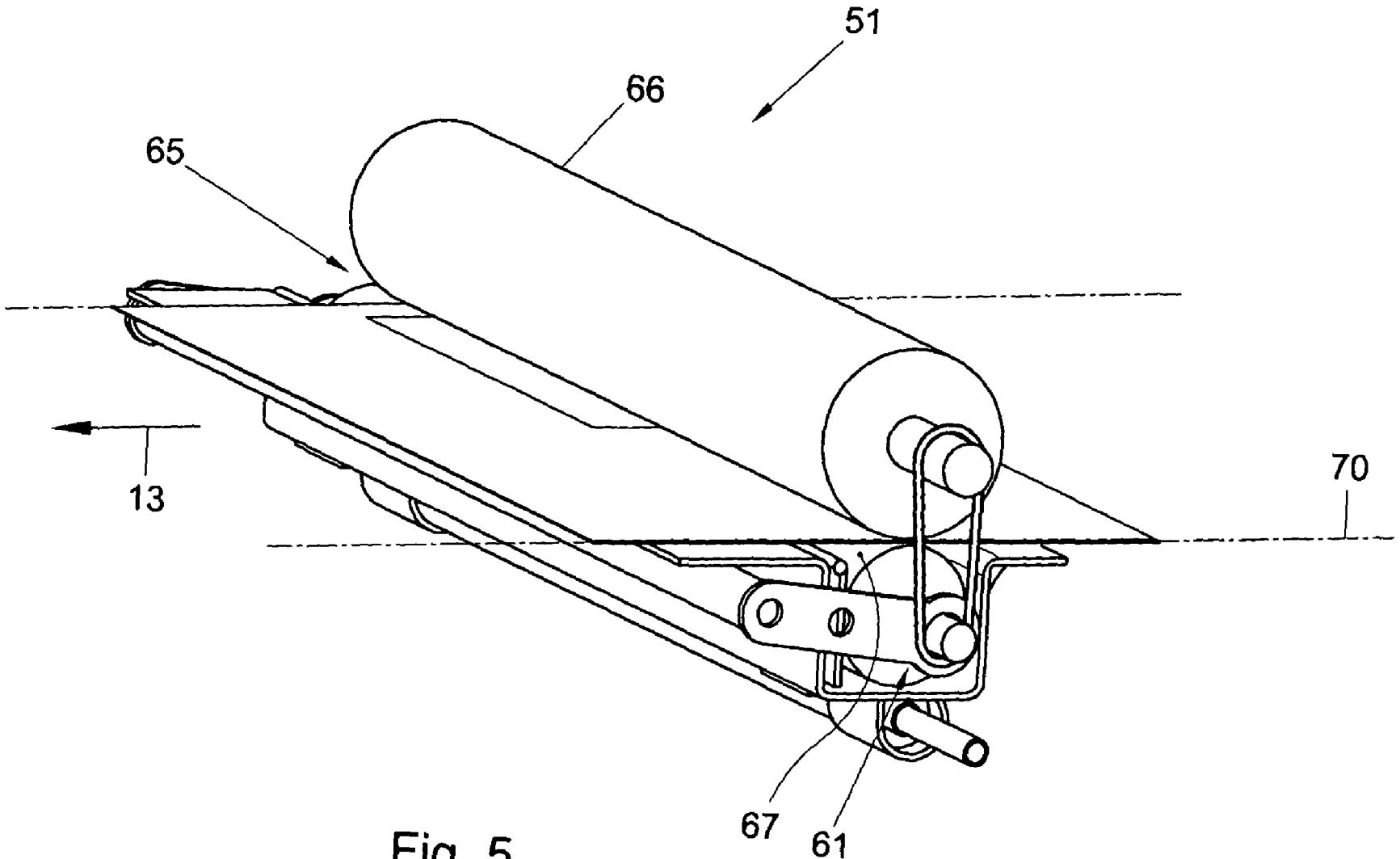
FIG. 5 is a schematic perspective representation of an alternative exemplary embodiment of an envelope closing mechanism according to the invention.

FIG. 5 shows an alternative exemplary embodiment of an envelope closing mechanism 51, wherein the deflector 61 at the same time forms a roller press for pressing-on the folded-up flap. To this end, the deflector 61 is designed as a roller 67 and a second roller press is provided in such a manner that this is located on a side of the transport path 70 opposite the first roller press 61 when the deflector 61 is in its deflecting position. This second roller press 66 is connected to the deflector 61 such that in the deflecting position, they together form a closing nip 65 situated in the transport path 70.

The invention claimed is:

1. An envelope closing mechanism, comprising:

a guide bounding an envelope transport path;

a transport structure for moving the envelope in at least one transport direction along the transport path;

a deflector for urging a flap of an envelope connected along a fold to an envelope body of the envelope from the transport path; and a moistener for moistening at least a portion of the flap of an envelope at a position on a first side of the transport path and spaced from the transport path;

wherein the deflector is movable between a position of rest on a second side of the transport path located opposite the moistener, and a deflecting position on said first side of the transport path for urging at least a portion of the flap of the envelope against the moistener, in which deflecting position the deflector leaves the transport path free for allowing the envelope to pass the deflector during transport along the transport path on a side of the deflector facing away from the moistener; and wherein the transport structure is controllable for transporting the envelope from a position in which the flap of the envelope extends between the moistener and the deflector in the deflecting position, with said fold leading and following the transport path along the deflector in the deflecting position.

2. An envelope closing mechanism according to claim 1, wherein the deflector is elongated in cross direction of the transport path.

3. An envelope closing mechanism according to claim 2, wherein the deflector comprises at least one roller which has a rotation axis parallel to a plane in which envelopes extend in the transport path.

4. An envelope closing mechanism comprising:

a guide for guiding an envelope in a transport path;

a transport structure for moving the envelope in at least one transport direction along the transport path;

a deflector for urging a flap of an envelope connected along a fold to an envelope body of the envelope from the transport path; and a moistener for moistening at least a portion of the flap of an envelope at a position on a first side of the transport path and at a distance from the transport path;

wherein the deflector is movable between a position of rest on a second side of the transport path located opposite the moistener, and a deflecting position on said first side of the transport path for urging at least a portion of the flap of the envelope against the moistener, in which deflecting position the deflector leaves the transport path free for allowing the envelope to pass the deflector during transport along the transport path; and wherein the transport structure is controllable for transporting the envelope from a position in which the flap of the envelope extends between the moistener and the deflector in the deflecting position, with said fold leading and following the transport path along the deflector in the deflecting position, and wherein the guide comprises a panel which is movable between a moistener shielding position between the moistener and the deflector, and a moistener releasing position at a greater distance from the moistener than the deflector in the deflecting position.

5. An envelope closing mechanism according to claim 4, wherein the panel is suspended such that in operative condition, it is permanently urged towards its shielding position, while the deflector is designed, upon movement towards its deflecting position, to urge the panel to the moistener releasing position.

6. An envelope closing mechanism according to claim 1, wherein the deflector in the deflecting position is clear of the moistener.

7. An envelope closing mechanism according to claim 1, wherein the moistener is situated on a side of the deflector in the deflecting position remote from the transport path.

8. An envelope closing mechanism according to claim 1, further comprising a pump for moistening a dispensing part of the moistener in a dosed manner.

9. An envelope closing mechanism according to claim 1, further comprising at least one roller press and a circulating press-on surface located opposite the roller press forming, with the roller press, a press-on nip for pressing-on the folded-up flap against the envelope body.

10. An envelope closing mechanism, comprising:

a guide bounding an envelope transport path;

a transport structure for moving the envelope in at least one transport direction along the transport path;

a deflector for urging a flap of an envelope connected along a fold to an envelope body of the envelope from the transport path; and a moistener for moistening at least a portion of the flap of an envelope at a position on a first side of the transport path and spaced from the transport path;

wherein the deflector is movable between a position of rest on a second side of the transport path located opposite the moistener, and a deflecting position on said first side of the transport path, between the moistener and the envelope transport path, for urging at least a portion of the flap of the envelope against the moistener, in which deflecting position the deflector is free from the transport path for allowing the envelope to pass the deflector during transport along the transport path on a side of the deflector facing away from the moistener; and wherein the transport structure is controllable for transporting the envelope from a position in which the flap of the envelope extends between the moistener and the deflector in the deflecting position, with said fold leading and following the transport path along the deflector in the deflecting position.

11. An envelope closing mechanism, comprising:

a guide bounding an envelope transport path;

a roller press and an opposite press-on surface for feeding the envelope, with the flap leading, between the roller press and the opposite press-on surface in a feed direction to a position in which the envelope body and the flap extend in transport direction of a transport path;

a deflector for urging a flap of an envelope connected along a fold to an envelope body of the envelope from the transport path; and a moistener for moistening at least a portion of the flap of an envelope at a position on a first side of the transport path and spaced from the transport path;

wherein the deflector is movable between a position of rest on a second side of the transport path located opposite the moistener, and a deflecting position on said first side of the transport path for urging at least a portion of the flap of the envelope against the moistener, in which deflecting position the deflector is free from the transport path for allowing the envelope to pass the deflector during transport along the transport path on a side of the deflector facing away from the moistener; and wherein the roller press and the opposite press-on surface are drivable for transporting the envelope from a position in which the flap of the envelope extends between the moistener and the deflector in the deflecting position, with said fold leading and following the transport path along the deflector in the deflecting position and discharging the envelope between the roller press and the opposite press-on surface in a direction opposite to the feed direction, while the closed flap is being pressed on between the roller press and the opposite press-on surface.

* * * * *

UNITED STATES PATENT AND TRADEMARK OFFICE

CERTIFICATE OF CORRECTION

PATENT NO. : 7,748,426 B2
APPLICATION NO. : 11/319236
DATED : July 6, 2010
INVENTOR(S) : Fransiscus Hermannus Feijen It is certified that error appears in the above-identified patent and that said Letters Patent is hereby corrected as shown below:

On the Title page, Item (73) Assignee: Delete "NEOPOST TECHNOLOGIES" and insert --NEOPOST S.A.--

Signed and Sealed this

Thirtieth Day of November, 2010

David J. Kappos

David J. Kappos
*Director of the United States Patent and Trademark Office*